US005500665A

United States Patent [19]

Ujita et al.

[11] Patent Number: 5,500,665

[45] Date of Patent: Mar. 19, 1996

[54] INK CONTAINER AND INK JET RECORDING APPARATUS USING SAME

[75] Inventors: Toshihiko Ujita, Yamato; Haruyuki Matsumoto, Yokohama, both of Japan

[73] Assignee: Canon Kabushiki Kaisha, Tokyo, Japan

[21] Appl. No.: 311,887

[22] Filed: Sep. 26, 1994

Related U.S. Application Data

[63] Continuation of Ser. No. 933,318, Aug. 21, 1992, abandoned.

[30] Foreign Application Priority Data

Aug. 30, 1991 [JP] Japan ..... 3-244897

[51] Int. Cl.[6] ..... B41J 2/175

[52] U.S. Cl. ..... 347/86; 347/87

[58] Field of Search ..... 347/85, 86, 87

[56] References Cited

U.S. PATENT DOCUMENTS

| | | | |
|---|---|---|---|
| 4,124,853 | 11/1978 | Kattner et al. | 346/140 R |
| 4,158,847 | 6/1979 | Heinzl et al. | 346/140 R |
| 4,313,124 | 1/1982 | Hara | 346/140 R |
| 4,345,262 | 8/1982 | Shirato et al. | 346/140 R |
| 4,419,677 | 12/1983 | Kasugayam et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 6/1986 | Hori | 346/140 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | |
|---|---|---|
| 0486309 | 5/1992 | European Pat. Off. . |
| 54-056847 | 5/1979 | Japan . |
| 59-007057 | 1/1984 | Japan . |
| 59-123670 | 7/1984 | Japan . |
| 59-138461 | 8/1984 | Japan . |
| 60-071260 | 4/1985 | Japan . |
| 60-157871 | 8/1985 | Japan . |
| 60-204355 | 10/1985 | Japan . |

*Primary Examiner*—Benjamin R. Fuller
*Assistant Examiner*—Valerie Ann Lund
*Attorney, Agent, or Firm*—Fitzpatrick, Cella, Harper & Scinto

[57] ABSTRACT

An ink container includes a container body and a movable wall movable along an inside surface of the container body. The movable wall comprising has a sealing portion in sealing contact with the inside surface of the container body and at least one tilt preventing portion for preventing the movable wall from tilting. The tilt preventing portion is spaced from the sealing portion.

5 Claims, 6 Drawing Sheets

INK CONTAINER AND INK JET RECORDING APPARATUS USING SAME

This application is a continuation of application Ser. No. 07/933,318 filed Aug. 21, 1992, now abandoned.

FIELD OF THE INVENTION AND RELATED ART

The present invention relates to an ink container and an ink jet recording apparatus using the same, usable as a printer, copying machine or facsimile machine.

In an ink jet recording apparatus, there is provided an ink leakage preventing means with which an ink level in an ink container is maintained at a lower position than an ejection outlet of a recording head to prevent leakage of the ink through the ejection outlet, and a vacuum is produced in an ink supply system using capillary force in the capillary tube in the ink supply system between the ink container and the ejection outlet. This type of ink leakage preventing means limits the position of the ink container relative to the recording head and limits the shape of the ink container.

As a proposal for the solution to the problems, Japanese Laid-Open Patent Application Nos. 204,355/1985 discloses a structure as shown in FIGS. 8A and 8B. A movable wall is disposed in the ink container 201, and the movable wall moves toward a discharge port 203 in accordance with consumption of the ink through the port 203. By the friction force at the interface between the movable wall and the inside surface of the ink container 201, the vacuum of the ink is controlled in the ink container 201. FIG. 8A shows an example of the movable wall 204 with an O-ring 202 at the periphery thereof. FIG. 8B shows an example of the movable wall 304 in the form a diaphragm made of elastic material.

With this proposal, in order to maintain the sealing property between the movable wall and the ink container and in order to prevent tilting of the movable wall, it is required that the rigidities of the O-ring and the diaphragm have to be large and/or that the thicknesses of the O-ring and the diaphragm are large to increase the contact area with the ink container. As a result, the friction between the movable wall and the inside of the ink container is increased resulting in a large starting resistance against the movement of the movable wall. In other words, with the result that the pressure difference required to start the motion of the movable wall is substantial. This gives rise to a problem of the difficulty in the high level ink vacuum control. The large starting pressure imposes difficulty in the smooth movement of the entirety of the movable wall, and therefore, the tilting of the movable wall tends to occur.

SUMMARY OF THE INVENTION

Accordingly, it is a principal object of the present invention to provide an ink container and an ink jet recording apparatus using the same in which the friction between the movable wall and the inside surface of the container is reduced to permit the vacuum control with high accuracy.

According to an aspect of the present invention, there is provided an ink container comprising: a container body; a movable wall movable along an inside surface of said container body; said movable wall comprising a sealing portion in sealing contact with the inside surface of said container body and at least one tilt preventing portion for preventing said movable wall from tilting, said tilt preventing portion being spaced from said sealing portion.

It is possible that at least one of the tilt preventing member is provided with a sealing function relative to the ink container and/or that a material which is insoluble with the ink is disposed between the movable wall and the inside surface of the ink container.

It is also possible that the movable wall is integrally formed of elastic material and/or above that a recess is formed in at least one side of the movable wall.

It is advantageous that a bubble or elastic material is contained in the ink container.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6A and 6B are graphs showing vacuum in relation to the motion of the movable wall, in which FIG. 6A represents it without a bubble in the ink container, and FIG. 6B represents it with a bubble therein.

FIG. 8A and 8B show conventional ink containers, in which FIG. 8A shows an example having a movable wall with an O-ring, and FIG. 8B shows an ink container having a movable wall in the form of a diaphragm.

DESCRIPTION OF THE PREFERRED EMBODIMENTS

Figure 1:
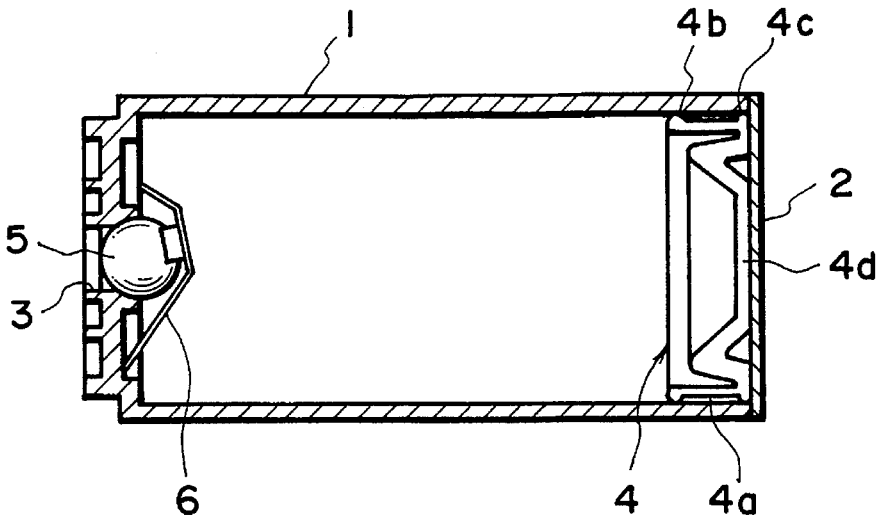
FIG. 1 is a sectional view of an ink container according to a first embodiment of the present invention.
Figure 2:
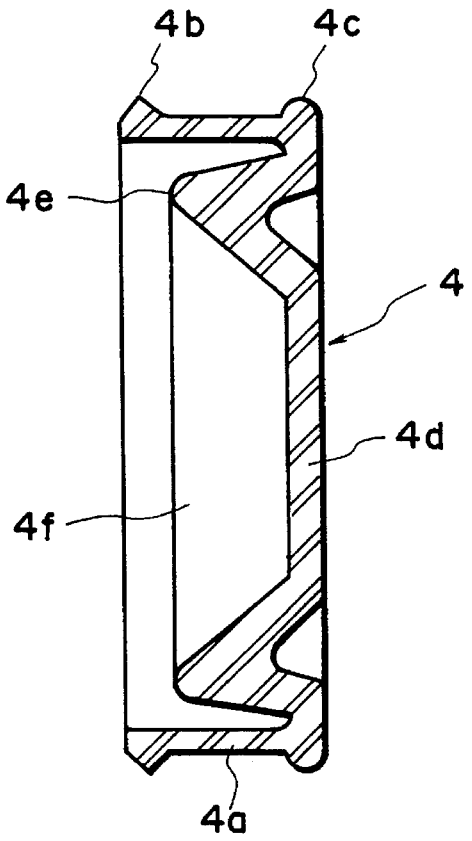
FIG. 2 is an enlarged sectional view of a movable wall in the ink container according to the first embodiment of the present invention.

Referring to FIG. 1, there is shown an ink container according to a first embodiment of the present invention in cross-section. FIGS. 2 is an enlarged sectional view of a movable wall.

As shown in FIG. 1, an ink container 1 is generally in cylindrical form. A bottom wall thereof is provided with a discharge port 3 for permitting supply of the ink therefrom. The discharge port 3 is closed with a ball 5 which is normally urged the direction for closing the discharge port 3 by a spring 6. An open end of the container 1 is closed by a back cover 2. In the container 1, there is provided a movable wall 4 which is movable to the left or right along the inside surface of the main body of the container 1. The back cover is provided with a small venting hole to permit introduction of air in accordance with movement of the movable wall, thus permitting the smooth motion of the movable wall.

As shown in FIG. 2, the movable wall 4, made of flexible elastic material such as rubber or synthetic resin material, is generally in the form of a cylinder. The bottom of the movable wall 4 is formed into an annular projection 4*e*, which encloses a recess 4*f* therein. A flange portion 4*a* of the movable wall 4 is provided with a sealing portion 4*b* for providing sealing effect on an outer periphery of the flange adjacent a side toward the inside of the container, and is provided with a tilt preventing projection 4*c* on an outer periphery of the flange adjacent a bottom wall 4*d*.

The sealing portion 4*b* has a diameter which is substantially equal to or slightly larger than a diameter of the inside surface of the container 1 to provide satisfactory sealing effect therebetween. The sealing member 4*b* is significantly influential to the starting pressure at the time of the ink supply. Therefore, it provides sufficient sealing without too much tight contact with the inside wall surface of the container 1. Thus, a relatively small friction force therebetween is established. Since a small contact area therebetween is desirable, the sealing portion 4*b* is tapered to provide an acute angle at the top thereof.

The tilt preventing projection 4*c* is provided to prevent the tilting motion of the movable wall, and therefore, it is not absolutely necessary to be in contact with the inside wall of the container.

In this embodiment, the movable wall is provided both with the sealing portion 4*b* and the tilt preventing projection 4*c* with a predetermined distance therebetween, by which the vacuum control is enabled in accordance with uniform small pressure changes with uniform and a small starting pressure.

In operation, when the container 1 is filled with ink, as shown in FIG. 1, the movable wall 4 is in the container close to the back cover 2. The ball 5 closes the discharge port 3 by being pressed to a tapered surface of the discharge port 3 by the spring force of the spring 6.

Figure 3A:
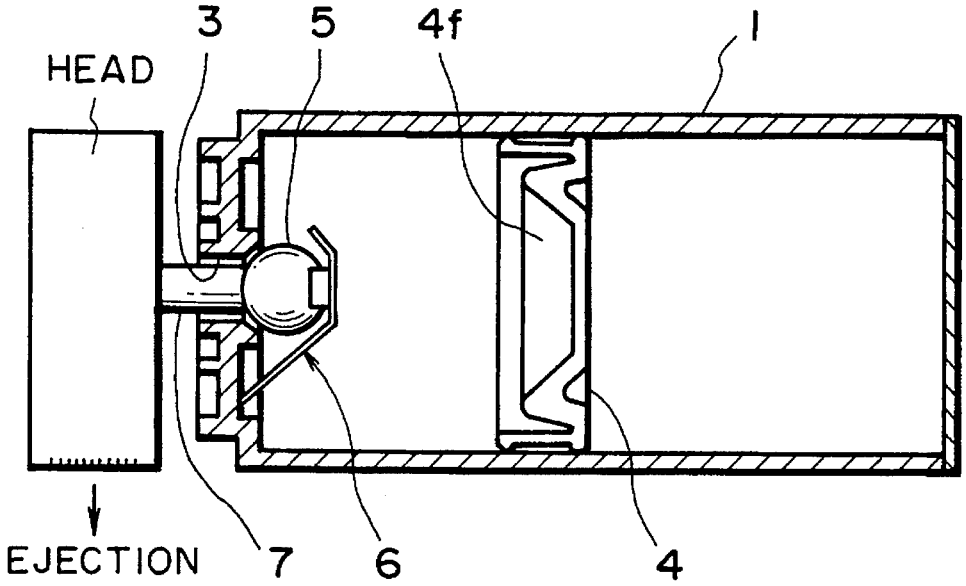
FIG. 3A is a sectional view of the ink container in which the movable wall comes to a central position of the ink container.
Figure 3B:
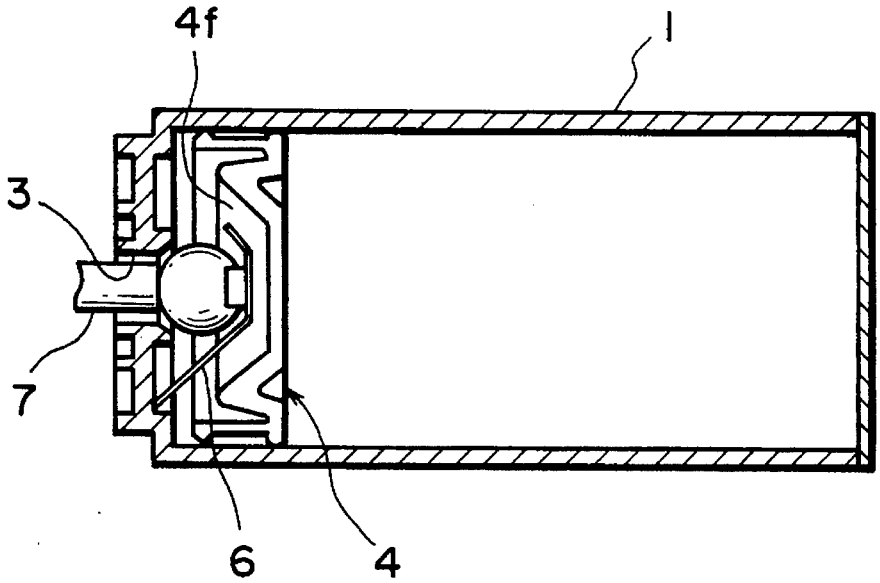
FIG. 3B is similar to FIG. 3A, but the movable wall has reached the position closest to a discharge port.

The ink container of this embodiment is mounted to a recording head or the like. At this time, as shown in FIG. 3A, an ink supply pipe 7 of the recording head pushes the ball 5 against the spring force of the spring 6 to disengage the ball 5 from the tapered surface of the discharge port 3, thus opening the discharge port 3. When the recording operation is started, the ink 10 is discharged through the discharge port 3. With the consumption of the ink, as shown in FIG. 3A, the movable wall 4 slides on the inside surface of the container i toward the discharge port 3. The friction against the sliding motion functions as a vacuum for the recording head. The inside wall of the container 1 is contacting the sealing portion 4*b* and the projection 4*c* of the movable wall 4. Therefore, the movable wall 4 smoothly moves without tilting, and therefore, constant vacuum can be maintained. With further consumption of the ink, as shown in FIG. 3B, the movable wall approaches the discharge port 3. A projected portion of a valve mechanism including the spring 6 or the like urging the ball 5, is accommodated in the recess 4*f* of the movable wall, thus permitting efficient use of the ink in the container 1.

Figure 4A:
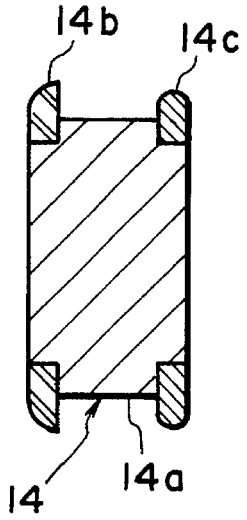
FIGS. 4A, 4B and 4C are sectional views of the movable walls used in the ink containers according to a second, third and fourth embodiments of the present invention.
Figure 4B:
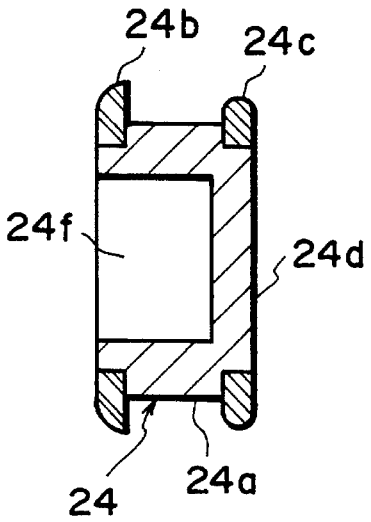
Figure 4C:
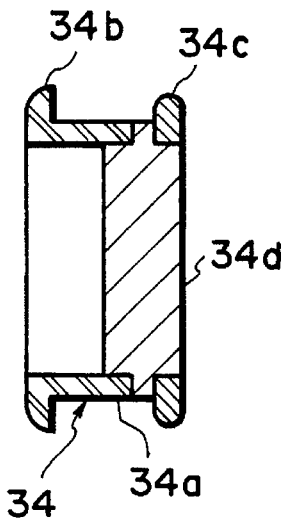

Referring to FIGS. 4A, 4B and 4C, description will be made to additional embodiments. In FIG. 4A, a sealing portion 14*b* is clamped on a stepped portion of the flange 14*a* adjacent left end in FIG. 4A. In addition, a separate tilt preventing projection 14*c* is clamped on a stepped portion adjacent the right end of the flange 14*a*.

In FIG. 4B, there is shown a further embodiment which is different from the second embodiment only in the structure of the flange 24*a* of the movable wall. The flange 24*a* is in the form of a cylinder, and the inside space thereof provides the recess 24*f*. The sealing member 24*b* is clamped on the stepped portion formed in the outer periphery of the flange 24*a* adjacent the open end of the recess 24*f*. On a step portion formed in the outer periphery of the flange adjacent the bottom wall 24*d*, a projection 24*c* member is clamped to prevent the tilting of the movable wall 4.

In FIG. 4C a cylindrical member 34*a* is used which is made of elastic material and which has an integral sealing portion 34*b*. The end portion of the cylindrical member 34*a* which is opposite from an end having the sealing portion 34*b* is clamped on the stepped portion of the bottom wall 34*d*. A projected portion 34*c* is clamped on a stepped portion of the bottom wall 34*d* adjacent the other end.

In any of the ink containers described above, a material 12 (see FIG. 3A) which is insoluble with the ink is preferably disposed between the movable wall and the container 1 to improve the lubricant effect and the sealing effect.

Examples of the insoluble material include liquids such as silicone oil, fluorine oil, polybutene, polyisobutylene or the like, solid lubricant such as molybdenum disulfide, graphite, boron nitride or the like, or coating material such as polytetrafluoroethylene or the like.

It is preferable that at least a part of the material insoluble with the ink is retained in a space between the sealing portion and the tilt preventing portion, since then the insoluble material functions both between the sealing portion and the inside surface of the container and between the tilt preventing portion and the inside surface of the container, and therefore, the sealing effect and the friction property are enhanced. In addition, even if there occurs a gap between the sealing portion and the inside surface of the container due to vibration of the ink container produced by, for example, carrying the container around, the ink leakage can be effectively prevented because of the existence of the insoluble material.

In each of the ink containers, it is a possible modification that two or more of the tilt preventing projections are provided, and at least one of them functions to provide the sealing effect relative to the inside surface of the container 1.

Figure 5:
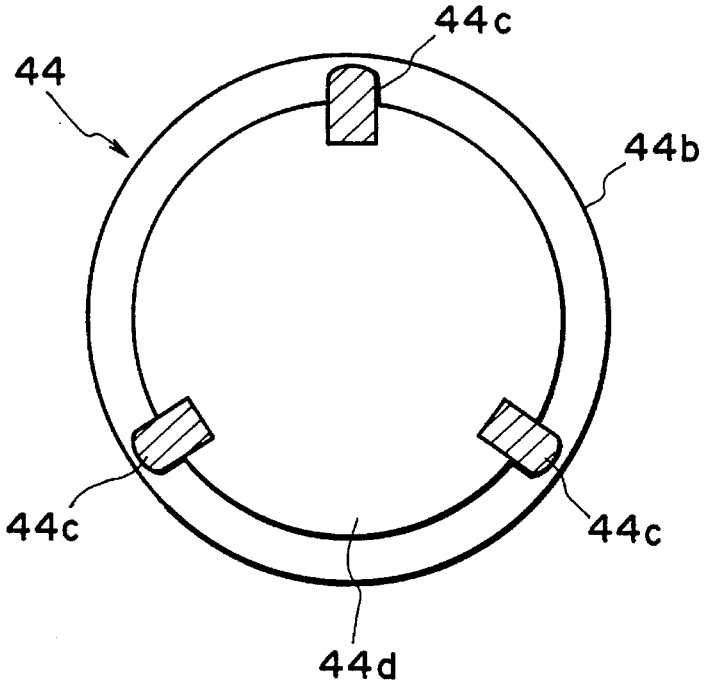
FIG. 5 shows a movable wall of a container according to a further embodiment of the present invention, as seen from the backside.

In the foregoing embodiments, the tilt preventing member is in the form of a ring. However, when the insoluble material is not retained, the tilt preventing portion may be in the form of plural projections 44*c* on the peripheral surface of the bottom wall 44*d*, as shown in FIG. 5. By doing so, the contact area with the inside surface of the container may be reduced, thus permitting fine movement of the movable wall 44. In this Figure, three tilt preventing projections 44*c* are provided on the peripheral surface of the bottom wall 44*d*. However, the number is not limited, and therefore, may be two if it has sufficient sides to prevent the tilting of the movable wall 44. It may be four or larger. When the discrete tilt preventing projections are employed, and when the use of the insoluble material is desired, the sealing portion may be in the form of double rings, between which the insoluble material is disposed, or the sealing portion has a cross-section in the form of a channel, in which the insoluble material is retained.

The sealing portion and/or the tilt preventing portion may be integrally formed with the movable wall, or may be a separate member.

Figure 6A:
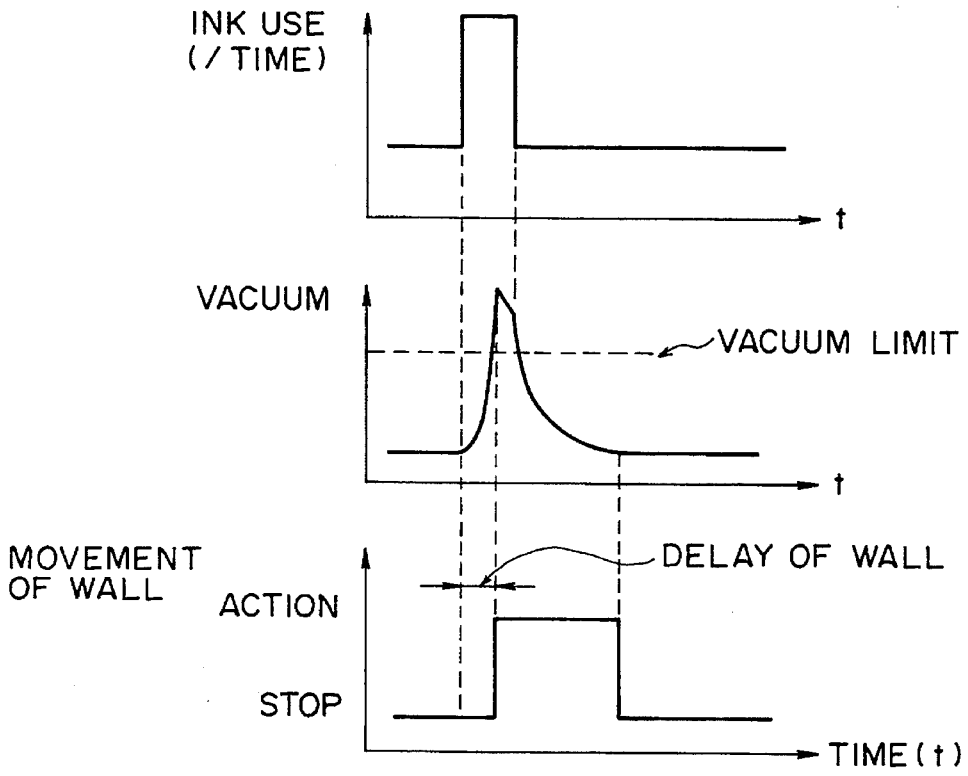
Figure 6B:
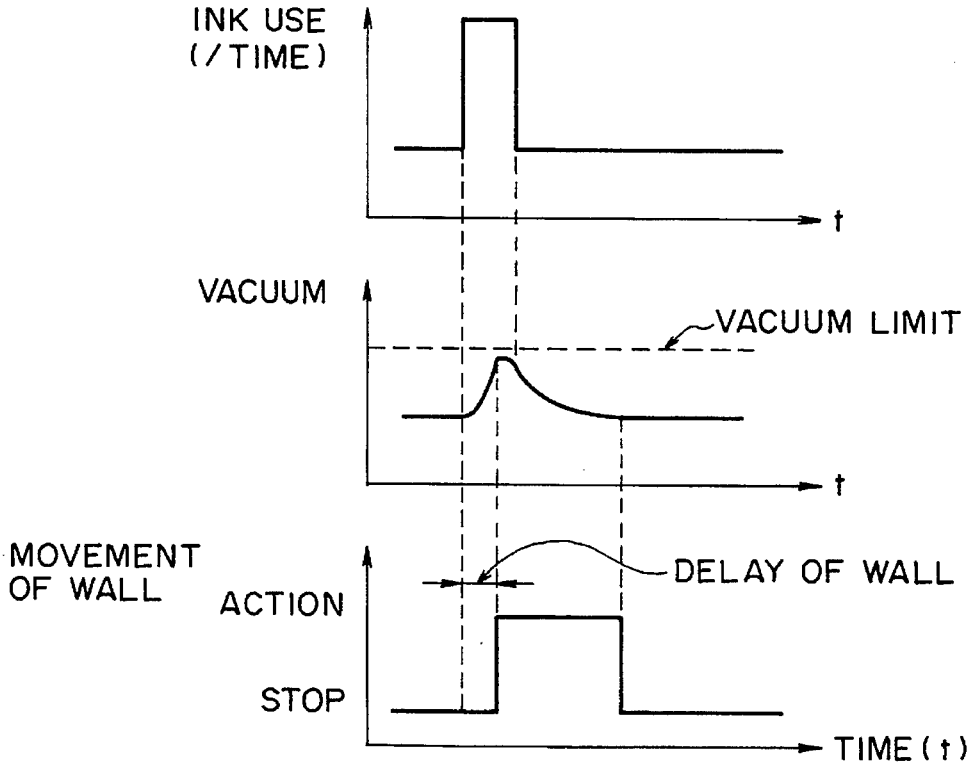

A further embodiment will be described in which air or gas exists in the form of a bubble 16, bubbles or the like in the ink existing side of the movable wall (see FIG. 3A, for example). FIG. 6A is a graph of changes, with time, of the ink consumption, the ink vacuum and the movement of the movable wall, when there is no bubble, and FIG. 6B shows the same but with the bubble.

When the ink is suddenly ejected from all of the nozzles of the recording head as in the case when a solid black image suddenly appears during a substantially constant ink consumption operation in a normal operation, that is, when the ink consumption abruptly increases, the ink is going to be supplied from the container to the recording head. However, the movement of the movable wall is delayed, as shown in the figures because the volume of the liquid ink hardly expands and thus the vacuum of the ink may abruptly increase. If the vacuum becomes stronger than the liquid maintaining force by the meniscus formed at the ejection outlets of the recording head, or when the vacuum limit is exceeded so that the ink refilling action is prevented, the ink may not be ejected through an ejection outlet or outlets. When a bubble or bubbles exist, the bubble expands in the ink container even if the consumption rate of the liquid ink abruptly increases, and the bubble functions as a damper or absorber, and therefore, the vacuum limit is not exceeded. Therefore, there is no possibility ejection failure.

The volume of the bubble or bubbles required to prevent the vacuum limit from being exceeded when the movable wall does not move even if all the ejection outlets eject continuously ink droplets for a solid black image of 5 character areas (one area 64×36 dots), is about 0.1 cc.

For normal solid image printing, it will suffice if the volume is not less than 0.05 cc. If it is too large, the ink may significantly move when the container is vibrated. The influence thereof may be transmitted to the recording operation of the recording head. Therefore, it is preferably less than 1 cc. In place of the bubble, an elastic material or materials may be contained.

Figure 7:
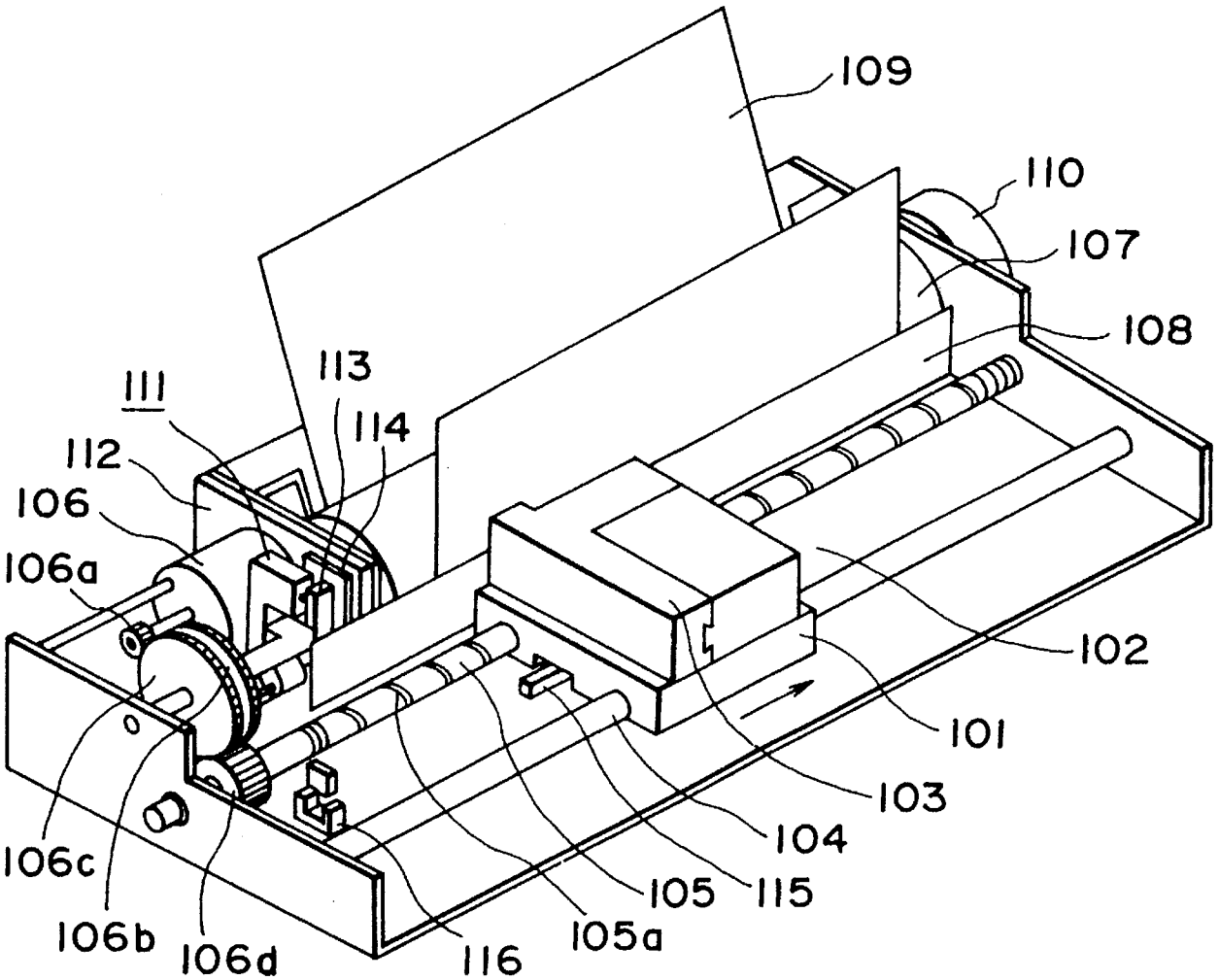
FIG. 7 is a perspective view of an ink jet recording apparatus according to an embodiment of the present invention, using an ink container according to an embodiment of the present invention.
Figure 8A:
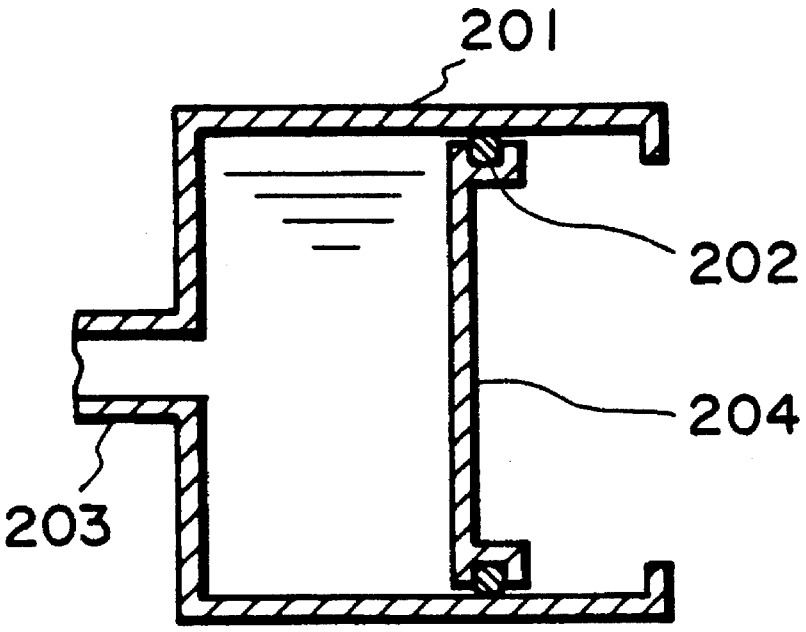
FIG. 8A PRIOR ART
Figure 8B:
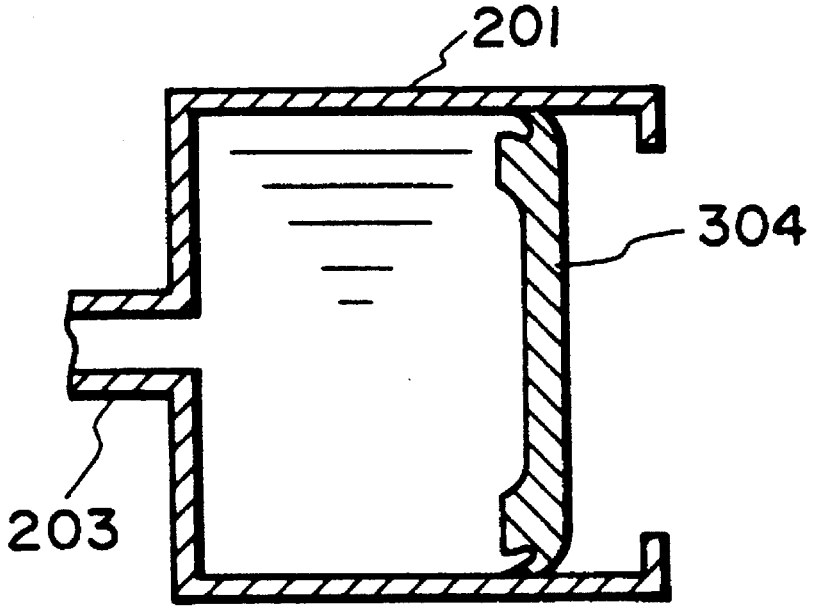
FIG. 8B PRIOR ART

Referring to FIG. 7, an ink jet recording apparatus using the ink container according to this invention will be described.

The recording head 103 and the ink container according to this embodiment are joined so as to constitute a recording head unit. The recording head unit is carried on a carriage 101, which is guided by a guiding shaft 104 and a lead screw 105 having a helical groove 105*a*. In an alternative arrangement, the ink container according to this invention may be mountable to the recording head. The recording head 103 is provided with a pipe or rod 7, as shown in FIGS. 3A and 3B, and when the ink container cassette 102 is mounted, the pipe or rod 7 is inserted into the discharge port of the container 1 to open the discharge port 3 against the spring force of the spring 6 on the ball 5.

The lead screw 105 is rotated in the forward and backward directions by a reversible motor 106 through gear trains 106*a*, 106*b*, 106*c* and 106*d*. The carriage 101 is reciprocated in the direction indicated by an arrow and in the opposite direction through an unshown pin of the carriage 101, the end portion of the pin being in engagement with the helical groove 105*a*. The switching between the forward rotation and the backward rotation of the driving motor 106 is effected in response to detection of the home position of the carriage 101, which is detected by a combination of a lever 115 of the carriage 101 and a photocoupler 116.

The recording material in the form of a sheet of paper 109 is fed around a platen 107 and passed a confining plate 108 to face the recording head by an unshown sheet feeding roller driven by a sheet feeding motor 110.

The recovery unit 111 functions to remove foreign matter deposited on the ejection outlet side of the recording head 103 or viscosity increased ink thereon so as to recovery the regular ejection performance.

The recovery unit 111 comprises a capping member 113 in communication with an unshown sucking means and sucks the ink through the ejection outlets of the recording head 103 which is capped to remove the foreign matter and the viscosity increased ink from the neighborhood of the ejection outlets. Between the recovery unit 111 and the platen 107, there is provided a cleaning blade 114 which is movable toward and away from the movement path of the ejection outlet side of the recording head 103, along a guiding member 112. A free end of the cleaning blade 114 is effective to remove the foreign matter and ink droplets deposited on the ejection outlet side surface of the recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 38461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the mountable recording head, it may be a single head corresponding to a single color ink, or may be plural head corresponding to a plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal in the present invention is applicable to other types of ink. In one of them, the temperature rise due to the thermal energy is positively prevented by consuming it for the state change of the ink from the solid state to the liquid state. Another ink material is solidified when it is left to prevent the evaporation of the ink. In either of the cases, the application of the recording signal producing thermal energy, the ink is liquified, and the liquified ink may be ejected. Another ink material may start to be solidified at the time when it reaches the recording material. The present invention is also applicable to such an ink material as is liquified by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet faces the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

Since the present invention has the structures described above, the following advantageous effects can be provided. Even if the friction between the movable wall and the inside surface of the container is selected to be low level, there is little possibility that the movable wall will tilt. Since the friction force is small, the pressure required for starting the movable wall is small, and therefore, the vacuum control can be made responsive to small pressure change, and therefore the reliability of the recording apparatus is increased.

Where the movable wall is provided with a recess, if an opening or closing means for opening the discharge port of the container is employed in the container, the recess is effective to accommodate the opening and closing means, and therefore, the amount of non-usable ink can be reduced correspondingly.

In the case of a recording head unit having an ink container and a recording head joined together, the ink capacity can be increased without increasing the size of the ink container. Furthermore, in an apparatus having such a recording head unit therein, the carriage structure does not become bulky, and therefore, the size of the entire apparatus does not become bulky, without obstructing the stabilized long term recording operation.

While the invention has been described with reference to the structures disclosed herein, it is not confined to the details set forth and this application is intended to cover such modifications or changes as may come within the purposes of the improvements or the scope of the following claims.

What is claimed is:

1. An ink container comprising:

a container body for containing ink; and a movable wall movable along an inside surface of said container body, said movable wall having a sealing portion in sealing contact with the inside surface of said container body and at least three circumferentially separated tilt preventing portions for preventing said movable wall from tilting, said tilt preventing portions being spaced from said sealing portion and contactable with the inside surface of said container body.

2. An ink container according to claim 1, wherein at least one of said tilt preventing portions is in sealing contact with the inside surface of said container body.

3. An ink container according to claim 1, further comprising a lubricant and sealing material in a space between said sealing portion and said tilt preventing portions and the inside surface of said container body, said lubricant and sealing material being insoluble with ink.

4. An ink container according to claim 1, wherein said sealing portion and said tilt preventing portions have elasticity.

5. An ink container according to claim 1, wherein a front face, with respect to movement direction of said movable wall, of said movable wall is provided with a recess.

* * * * *

UNITED STATES PATENT AND TRADEMARK OFFICE

CERTIFICATE OF CORRECTION

PATENT NO. : 5,500,665

DATED : March 19, 1996

INVENTOR(S) : TOSHIHIKO UJITA ET AL.

It is certified that error appears in the above-indentified patent and that said Letters Patent is hereby corrected as shown below:

IN THE DRAWINGS:

Sheet 2 of 6, FIG. 3A should be replaced with the following:

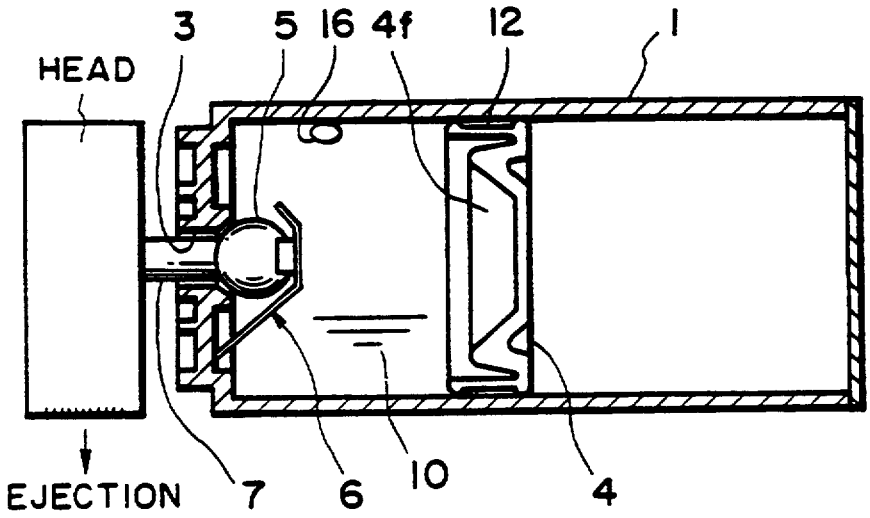

FIG. 3A

UNITED STATES PATENT AND TRADEMARK OFFICE

CERTIFICATE OF CORRECTION

PATENT NO. : 5,500,665

DATED : March 19, 1996

INVENTOR(S) : TOSHIHIKO UJITA ET AL.

It is certified that error appears in the above-indentified patent and that said Letters Patent is hereby corrected as shown below:

COLUMN 2

Line 54, "FIGS. 2" should read --FIG. 2--.
Line 61, "urged" should read --urged in--.

COLUMN 3

Line 31, "with uniform" should be deleted.
Line 47, "i" should read --1--.
Line 49, "contacting" should read --contacted by--.

COLUMN 4

Line 7, "wall 4." should read --wall 24.--.

COLUMN 5

Line 22, "possibility" should read --possibility of--.
Line 62, "passed" should read --past--.

COLUMN 6

Line 58, "No. 38461/1984" should read --138461/1984--.

UNITED STATES PATENT AND TRADEMARK OFFICE

CERTIFICATE OF CORRECTION

PATENT NO. : 5,500,665

DATED : March 19, 1996

INVENTOR(S) : TOSHIHIKO UJITA ET AL.

It is certified that error appears in the above-indentified patent and that said Letters Patent is hereby corrected as shown below:

COLUMN 7

Line 22, "head" should read --heads--.
Line 23, "head" should read --heads--.

Signed and Sealed this

First Day of October, 1996

Bruce Lehman

*Attest:*

BRUCE LEHMAN

*Attesting Officer*

*Commissioner of Patents and Trademarks*